US009654855B2

(12) United States Patent
Ring et al.

(10) Patent No.: US 9,654,855 B2
(45) Date of Patent: May 16, 2017

(54) SELF-VOICE OCCLUSION MITIGATION IN HEADSETS

(71) Applicant: Bose Corporation, Framingham, MA (US)

(72) Inventors: Martin David Ring, Ashland, MA (US); Steven H. Isabelle, Newton, MA (US)

(73) Assignee: Bose Corporation, Framingham, MA (US)

( * ) Notice: Subject to any disclaimer, the term of this patent is extended or adjusted under 35 U.S.C. 154(b) by 296 days.

(21) Appl. No.: 14/527,967

(22) Filed: Oct. 30, 2014

(65) Prior Publication Data

US 2016/0127829 A1 May 5, 2016

(51) Int. Cl.

| | |
|---|---|
| ***G10K 11/16*** | (2006.01) |
| ***H04R 1/10*** | (2006.01) |
| *H04R 5/033* | (2006.01) |

(52) U.S. Cl.

CPC ..... *H04R 1/10* (2013.01); *H04R 5/033* (2013.01); *H04R 2460/05* (2013.01)

(58) Field of Classification Search

CPC . A61B 5/12; H04R 3/04; H04R 25/00; H04R 2430/03; H04R 2460/05; H04R 1/10; H04R 5/033

USPC ..... 381/60, 61, 68, 71.4

See application file for complete search history.

(56) References Cited

U.S. PATENT DOCUMENTS

| | | | | |
|---|---|---|---|---|
| 7,627,352 | B2 | 12/2009 | Gauger, Jr. et al. | |
| 7,920,903 | B2 | 4/2011 | Ueda et al. | |
| 8,447,370 | B2 | 5/2013 | Ueda et al. | |
| 8,488,829 | B2 | 7/2013 | Ring | |
| 8,620,650 | B2 | 12/2013 | Walters et al. | |
| 8,798,278 | B2 | 8/2014 | Isabelle et al. | |
| 2011/0299692 | A1* | 12/2011 | Rung | H04R 25/70 381/60 |
| 2012/0076312 | A1 | 3/2012 | Iyengar | |

(Continued)

OTHER PUBLICATIONS

International Search Report and Written Opinion dated Dec. 22, 2015 for International Application No. PCT/US2015/057603.

(Continued)

*Primary Examiner* — Vivian Chin
*Assistant Examiner* — Ubachukwu Odunukwe

(57) ABSTRACT

A device includes an ear occlude, an output transducer that is acoustically coupled to an ear canal of a wearer of the device, a voice microphone configured to generate a first electrical signal that is proportional to a voice-generated sound pressure at the microphone, and signal processing circuitry, electrically coupled to the output transducer and the microphone, including a compensator configured to generate, from the first electrical signal, a second electrical signal, and output the second electrical signal to the output transducer, wherein the compensator is tuned to cause $G_OE$, a ratio of a sound pressure within the ear canal to a voice-generated sound pressure at a mouth reference point when the ear is occluded and electronically-aided to be approximately equal to $G_U$, a ratio of the sound pressure within the ear canal to the voice-generated sound pressure at the mouth reference point when the ear is unoccluded.

18 Claims, 7 Drawing Sheets

(56) References Cited

U.S. PATENT DOCUMENTS

| | | | | |
|---|---|---|---|---|
| 2012/0076320 | A1 | 3/2012 | Iyengar | |
| 2014/0126735 | A1* | 5/2014 | Gauger, Jr. ..... | G10K 11/1788 381/71.6 |

OTHER PUBLICATIONS

Mejia Jorge et al: "Active cancellation of occlusion: An electronic vent for hearing aids and hearing protectors", The Journal of the Acoustical Society of America, American Institute of Physics for the Acoustical Society of America, New York, NY, US, vol. 124, No. I, Jul. 1, 2008 (Jul. 1, 2008). pp. 235-240, P012120265, ISSN: 0001-4966, 001: 10.1121/1.2908279 p. 238, left-hand column abstract.

Antoine Bernier et al: "An active hearing protection device for musicians", Proceedings of Meetings on Acoustics, ICA 2013, Montreal, vol. 19, Jun. 2, 2013 (Jun. 2, 2013), pp. 1-9, XP055235670, ISSN: 1939-800X, 001: 10.1121/1.4800066 p. 1-p. 6, line 11; figures 1-9.

* cited by examiner

SELF-VOICE OCCLUSION MITIGATION IN HEADSETS

BACKGROUND

This disclosure relates to mitigating self-voice occlusion in headsets.

A headset, whether wired or wireless, may include a pair of earphones with transducers for outputting audio signals and a microphone for detecting near-end speech uttered by a wearer of the headset.

A wearer of a headset with ear cups, ear buds or in-the-canal hardware (collectively "ear occluders") that occlude the wearer's ears will experience an effect, commonly called the "occlusion effect," which typically causes the wearer to perceive his voice as having over-emphasized lower frequencies and under-emphasized higher frequencies. The overall effect is that the wearer's voice sounds less natural to himself and may impede communication.

SUMMARY

In accordance with a first aspect, a device includes an ear occluder, an output transducer that is acoustically coupled to an ear canal of a wearer of the device, a voice microphone configured to generate a first electrical signal that is proportional to a voice-generated sound pressure at the microphone, and signal processing circuitry that is electrically coupled to the output transducer and the microphone. The circuitry includes a compensator configured to generate, from the first electrical signal, a second electrical signal, and output the second electrical signal to the output transducer, wherein the compensator is tuned to cause $G_O E$, a ratio of a sound pressure within the ear canal to a voice-generated sound pressure at a mouth reference point when the ear is occluded and electronically-aided to be approximately equal to $G_U$, a ratio of the sound pressure within the ear canal to the voice-generated sound pressure at the mouth reference point when the ear is unoccluded.

In some implementations of the first aspect, the compensator is a linear-time-invariant filter with a frequency response that is defined by $$K_C = \frac{G_U - G_O}{G_{MM} \times G_{DE}},$$

$G_O$ is a ratio of a sound pressure within the ear canal to the voice-generated sound pressure at the mouth reference point when the ear is occluded and unaided, $G_{MM}$ is a ratio of voltage output from the voice microphone to the voice-generated sound pressure at the mouth reference point, and $G_{DE}$ is a ratio of the sound pressure within the ear canal to the voltage input to a driver of the communications device.

In some implementations of the first aspect, the compensator is tuned to cause $G_O E$ to be approximately equal to $G_U$ over one or more predetermined bands of frequencies.

In some implementations of the first aspect, the compensator is tuned to cause $G_O E$ to be approximately equal to $G_U$ over a band of frequencies that experiences occlusion effect amplification.

In some implementations of the first aspect, the compensator is tuned to perform one or more of the following: roll off frequencies above a first threshold and roll off frequencies below a different, second threshold.

In some implementations of the first aspect, the compensator is tuned to actively attenuate low frequency self-voice sound pressure and amplify high frequency self-voice sound pressure within the ear canal.

In some implementations of the first aspect, the device further includes a second ear occluder, and a second output transducer that is electrically coupled to the signal processing circuitry and acoustically coupled to a second ear canal of the wearer of the device. The compensator is further configured to output the second electrical signal to the second output transducer. The compensator is tuned to cause $G_O E$, the ratio of the respective sound pressure within each of the first and the second ear canals to the voice-generated sound pressure at a mouth reference point to be approximately equal to $G_U$.

In some implementations of the first aspect, the ear occluder is a circumaural or supra-aural ear cup, an ear bud, or an in-the-canal component.

In accordance with a second aspect, in a device including an ear occluder, an output transducer that is acoustically coupled to an ear canal of a wearer of the device, a voice microphone configured to generate a first electrical signal that is proportional to a voice-generated sound pressure at the microphone, and signal processing circuitry, electrically coupled to the output transducer and the voice microphone, a method for mitigating self-voice occlusion includes generating, by a compensator of the circuitry, from the first electrical signal, a second electrical signal, and outputting the second electrical signal to the output transducer. The compensator is tuned to cause $G_O E$, a ratio of a sound pressure within the ear canal to a voice-generated sound pressure at a mouth reference point when the ear is occluded and electronically-aided to be approximately equal to $G_U$, a ratio of the sound pressure within the ear canal to the voice-generated sound pressure at the mouth reference point when the ear is unoccluded.

In some implementations of the second aspect, the method further includes tuning the compensator to have a frequency response that is defined by $$K_C = \frac{G_U - G_O}{G_{MM} \times G_{DE}},$$

where $G_O$ is a ratio of a sound pressure within the ear canal to the voice-generated sound pressure at the mouth reference point when the ear is occluded and unaided, $G_{MM}$ is a ratio of voltage output from the voice microphone to the voice-generated sound pressure at the mouth reference point, and $G_{DE}$ is a ratio of the sound pressure within the ear canal to the voltage input to a driver of the communications device.

In some implementations of the second aspect, the method further includes tuning the compensator to cause $G_O E$ to be approximately equal to $G_U$ over one or more predetermined bands of frequencies.

In some implementations of the second aspect, the method further includes tuning the compensator to cause $G_O E$ to be approximately equal to $G_U$ over a band of frequencies that experiences occlusion effect amplification.

In some implementations of the second aspect, the method further includes tuning the compensator to perform one or more of the following: roll off frequencies above a first threshold and roll off frequencies below a different, second threshold.

In some implementations of the second aspect, the method includes converting, by the transducer, the second electrical signal to acoustic energy that actively attenuates low frequency self-voice sound pressure in the ear canal and amplifies high frequency self-voice sound pressure in the ear canal.

In accordance with a third aspect, a device includes a first ear occluder and a second ear occluder, a first output transducer that is acoustically coupled to a first ear canal of a first ear of a wearer of the device, a second output transducer that is acoustically coupled to a second ear canal of a second ear of the wearer of the device, a voice microphone configured to generate a first electrical signal that is proportional to a voice-generated sound pressure at the microphone, signal processing circuitry, electrically coupled to the first and the second output transducers and the voice microphone. The circuitry includes a compensator configured to generate, from the first electrical signal, a second electrical signal, and output the second electrical signal to the first and the second output transducers, wherein the compensator is tuned to cause $G_O E$, an average ratio of a sound pressure within the first and the second ear canals to the voice-generated sound pressure at a mouth reference point to be approximately equal to $G_U$, a ratio of a sound pressure within the ear canal to the voice-generated sound pressure at the mouth reference point when the ear is unoccluded.

In some implementations of the third aspect, the compensator is a linear-time-invariant filter with a frequency response that is defined by $$K_C = \frac{G_U - G_O}{G_{MM} \times G_{DE}},$$

$G_O$ is an average ratio of the sound pressure within the first and the second ear canals to the voice-generated sound pressure at the mouth reference point when the ear is occluded and unaided, $G_{MM}$ is a ratio of voltage output from the communications voice microphone to the voice-generated sound pressure at the mouth reference point, and $G_{DE}$ is an average ratio of the sound pressure within the first and the second ear canals to the voltage input to a driver of the communications device.

In accordance with a fourth aspect, a device includes an ear occluder, an output transducer that is acoustically coupled to an ear canal of a wearer of the device, a voice microphone configured to generate a first electrical signal that is proportional to a voice-generated sound pressure at the microphone, and signal processing circuitry that is electrically coupled to the output transducer and the voice microphone. The circuitry includes a compensator configured to generate, from the first electrical signal, a second electrical signal, and output the second electrical signal to the output transducer. The compensator is tuned to cause $G_O E$, a ratio of a sound pressure within the ear canal to the voice-generated sound pressure at a mouth reference point when the ear is occluded and electronically-aided to be approximately equal to $G_T$, a target ratio of sound pressure within the ear to the voice-generated sound pressure at the mouth reference point when the ear is occluded and electronically-aided that is selected to provide a predetermined self-voice experience.

In some implementations of the fourth aspect, the compensator is a linear-time-invariant filter with a frequency response that is defined by $$K_C = \frac{G_T - G_O}{G_{MM} \times G_{DE}},$$

$G_O$ is a ratio of a sound pressure within the ear canal to the voice-generated sound pressure at the mouth reference point when the ear is occluded and unaided, $G_{MM}$ is a ratio of voltage output from the microphone to the voice-generated sound pressure at the mouth reference point, and $G_{DE}$ is a ratio of the sound pressure within the ear canal to the voltage input to a driver of the device.

In some implementations of the fourth aspect, $G_T = 2 * G_U$, where $G_U$ is a ratio of a sound pressure within the ear canal to the voice-generated sound pressure at the mouth reference point when the ear is unoccluded, and the predetermined self-voice experience is louder than a natural self-voice experience.

In some implementations of the fourth aspect, $G_T = 0.5 * G_U$, where $G_U$ is a ratio of a sound pressure within the ear canal to the voice-generated sound pressure at the mouth reference point when the ear is unoccluded, and the predetermined self-voice experience is softer than a natural self-voice experience.

In some implementations of the fourth aspect, the compensator is dynamically tuned in response to a user-controlled mode selection.

In some implementations of the fourth aspect, the compensator is dynamically tuned in response to detection that the headset is engaged in an active telephone call with a far-end communications device.

Hearing one's own voice sound unnatural can cause one to be self-conscious of how one sounds, which can be quite irritating and/or distracting. Advantages of reducing the occlusion effect include one or more of the following. Reducing the occlusion effect increases speaking ease by making the headset wearer more comfortable with how his own voice sounds. Also, reducing the occlusion effect and allowing the headset wearer to hear his own voice naturally encourages the headset wearer to speak at a normal level, for example, when talking to someone else (during a call or face-to-face), while providing voice commands, or when recording a voice memo.

All examples and features mentioned above can be combined in any technically possible way. Other features and advantages will be apparent from the description and the claims.

DESCRIPTION

A headset can be operated with or without self-voice occlusion mitigation. At times in this description, it will be useful to distinguish between those cases in which self-voice occlusion mitigation is inactive or active. As used herein, the term "occluded and unaided" refers to the former case and the term "occluded and electronically-aided" refers to the latter case. Note that in either case, the headset's physical characteristics and electro-acoustic features, including active noise reduction or noise canceling features, if available, have an effect on the sound signals that are delivered to the headset wearer and hence his perception of self-voice.

Figure 1A:
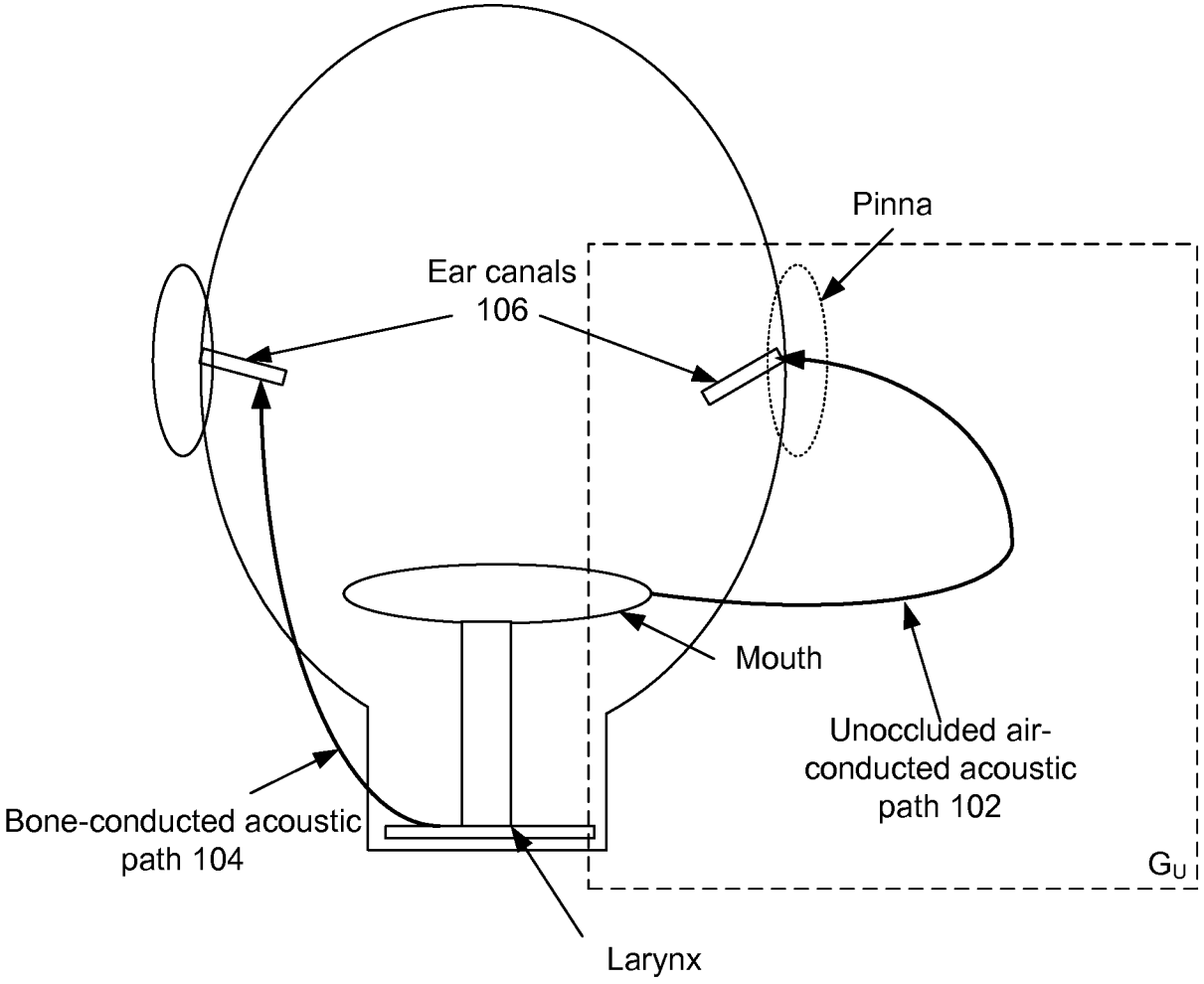
FIGS. 1A, 1B, and 1C each show acoustic paths from the larynx to the ear canals of a human.

Referring to FIG. 1A, when a person whose ears are unoccluded speaks, he hears his own voice via an unoccluded air-conducted acoustic path 102 and a body-conducted acoustic path 104. For the unoccluded air-conducted acoustic path 102, the voice propagates through the air causing an acoustic pressure within the person's ear canals 106. For the body-conducted acoustic path 104, the vibrations of the larynx are transmitted through the body and cause the walls of the ear canals 106 to vibrate. This vibration transduces into an acoustic pressure within the ear canals 106.

Figure 1B:
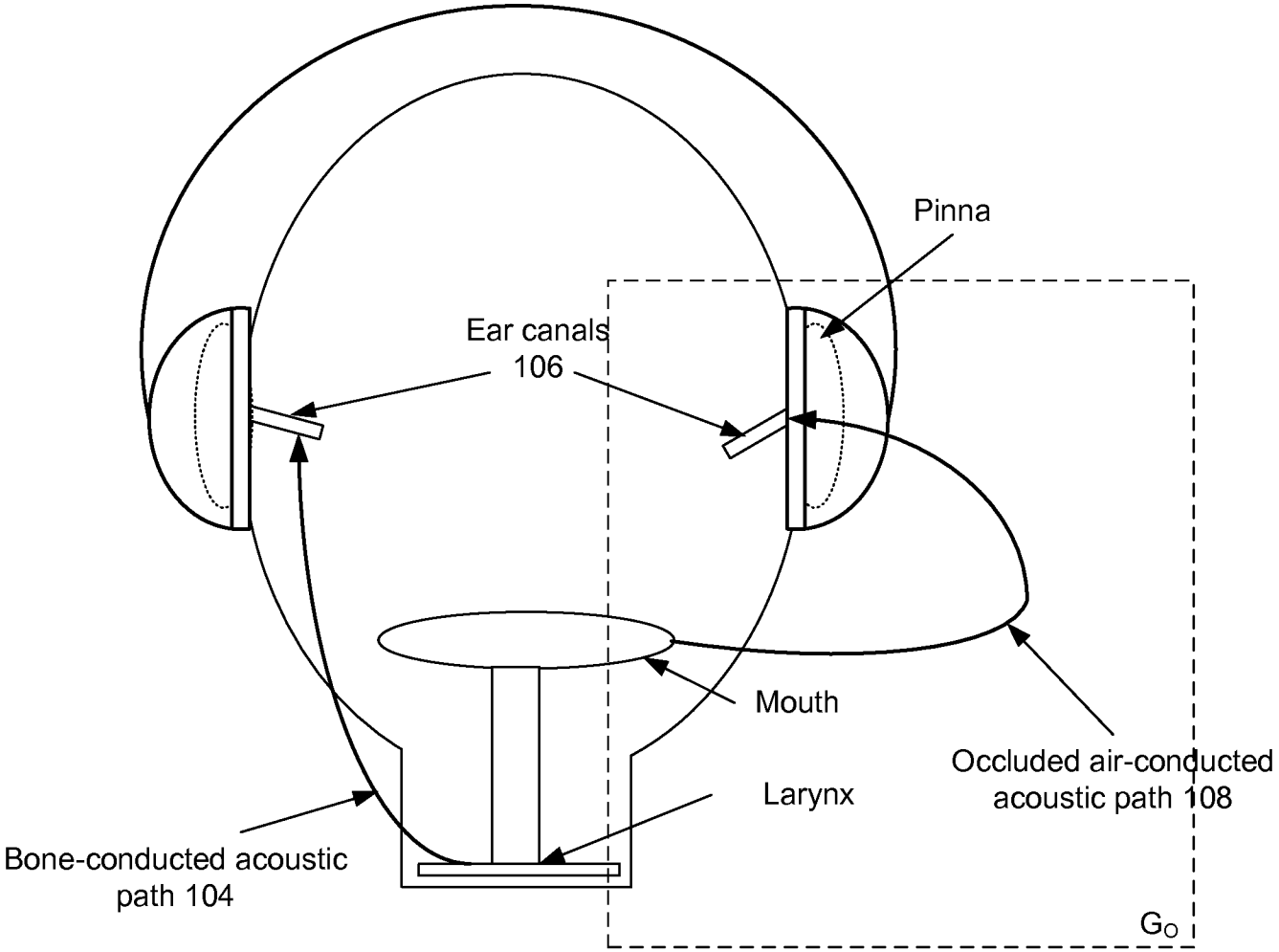

Referring to FIG. 1B, when a person whose ears are occluded and unaided speaks, he hears his own voice via an occluded air-conducted acoustic path 108 and the previously-described the body-conducted acoustic path 104. For the occluded air-conducted acoustic path 108, the voice propagates through the air and anything that occludes the ears causing an acoustic pressure within the person's ear canals.

Figure 1C:
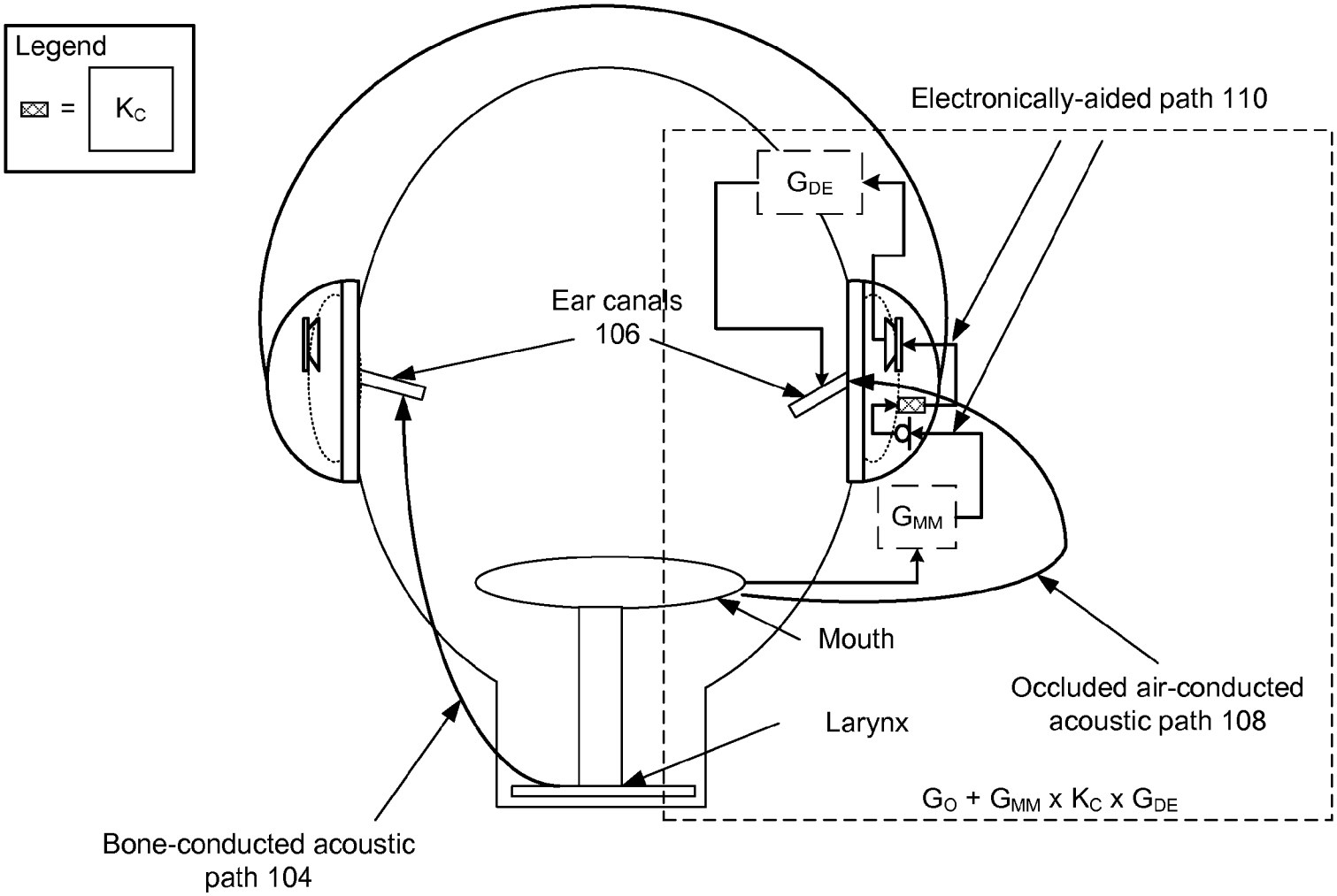

Referring to FIG. 1C, when a person whose ears are occluded and electronically-aided speaks, he hears his own voice via the previously-described occluded air-conducted acoustic path 108 and body-conducted acoustic path 104, as well as, an electronically-aided path 110. For the electronically-aided path 110, the voice is converted to an electrical signal which is transduced into an acoustic pressure in the ear canals 106 by an electro-acoustic transducer.

A person's perception of his own voice depends on the combination of these three acoustic pressures, which in turn depends upon whether the person's ears are unoccluded or occluded, unaided or electronically-aided. For example, when the ear canals are unoccluded as shown in FIG. 1A, the acoustic pressure created by the vibrating walls of the ear canal radiates into an infinite volume and is quite small compared to the pressures caused by the air-conducted acoustic path. On the other hand, when the ear canals are occluded as shown in FIGS. 1B and 1C, some or all of the air-conducted acoustic pressure is blocked, while the vibration of the ear canal walls transduces into a volume that is much, much smaller than an infinite volume resulting in higher body-conducted acoustic pressures and lower air-conducted acoustic pressures relative to the unoccluded case.

When describing the person's perception of his own voice, the term "self naturalness" generally refers to the effect of a person hearing his own voice as sounding natural. This description details techniques for mitigating the self-voice occlusion effect when a person's ears are occluded, for example, by one or more ear cups of a headset, thus improving self-naturalness for the headset user. In particular, we describe these techniques, implemented using a feed-forward system that includes a self-voice occlusion effect compensator, in the context of a circumaural headset 200 (FIG. 2) with passive noise reduction capabilities. However, the feed-forward system can be implemented to improve self-naturalness in any wired or wireless, circumaural, supra-aural or in-ear headset with active and/or passive noise reduction capabilities. In addition, although the feed-forward system is described below with reference to a headset that has a single communications microphone located on one of the earphones, the feed-forward system can also be implemented in a headset with one or multiple microphone arrays located in one or both of the earphones or in another location, or in a headset with a boom microphone.

Figure 2:
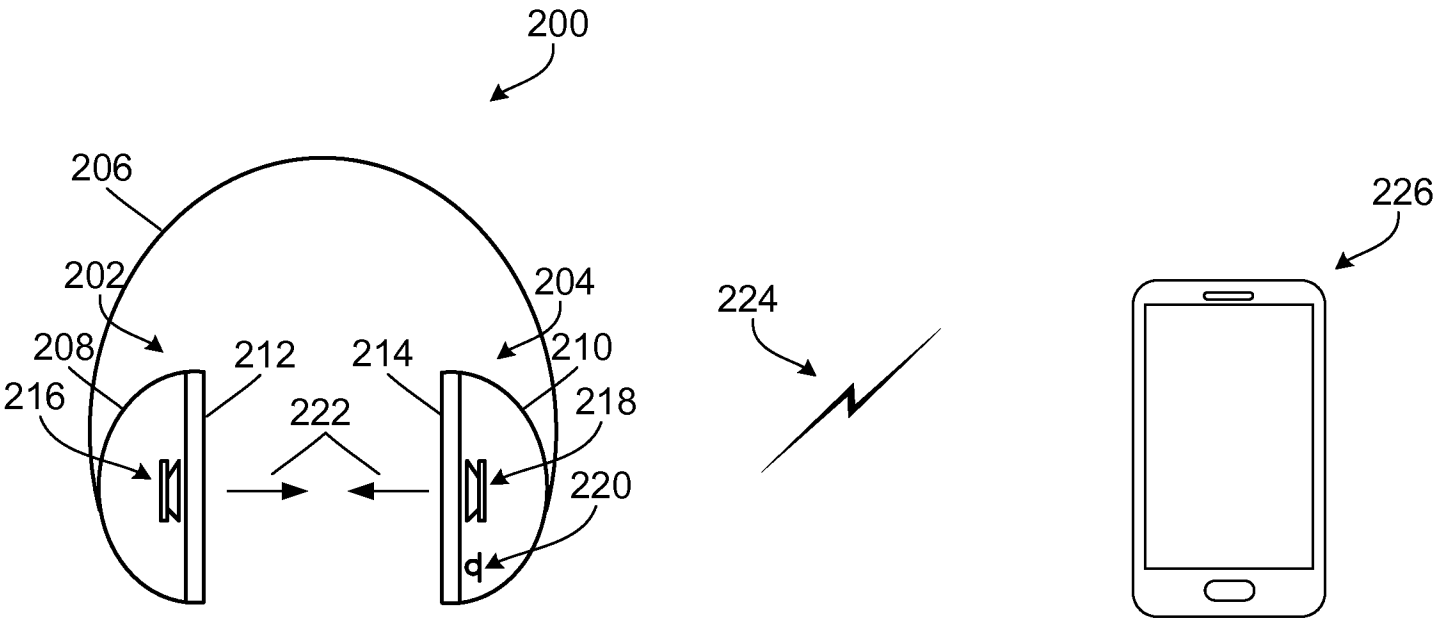
FIG. 2 shows a headset that is operable to transmit and receive control and audio signals over a communications link with a paired mobile telephone.

FIG. 2 shows a headset 200 that includes a left earphone 202 and a right earphone 204 connected by a headband 206. Each earphone 202, 204 includes a respective ear cup 208, 210, cushion 212, 214, and transducers 216, 218. A communications voice microphone 220 for detecting near-end speech uttered by a wearer of the headset is located within the right earphone 204. The headband 206 exerts a force in an inward direction as represented by arrows 222. The headset 200 is operable to transmit and receive control and audio signals over any communications link such as a wire or a Bluetooth™ link 224 with a paired mobile telephone 226.

When the headset 200 is positioned on a person's head, the cushion 212, 214 of each earphone 202, 204 deforms slightly to form a seal against the headset wearer's ear in the case of a supra-aural headset or against the headset wearer's head in the case of a circumaural headset. In the case of an in-ear headset (not shown), a seal is formed between an earpiece of the earphone and the concha or ear canal of the headset wearer. Each seal significantly reduces the amplitude of external acoustic energy reaching a respective ear canal of the headset wearer. Typically, lower frequency sound pressure resulting from the user's voice is amplified and higher frequency sound pressure is attenuated inside the ear canals of the headset wearer when the ears are occluded by the headset 200.

Figure 3:
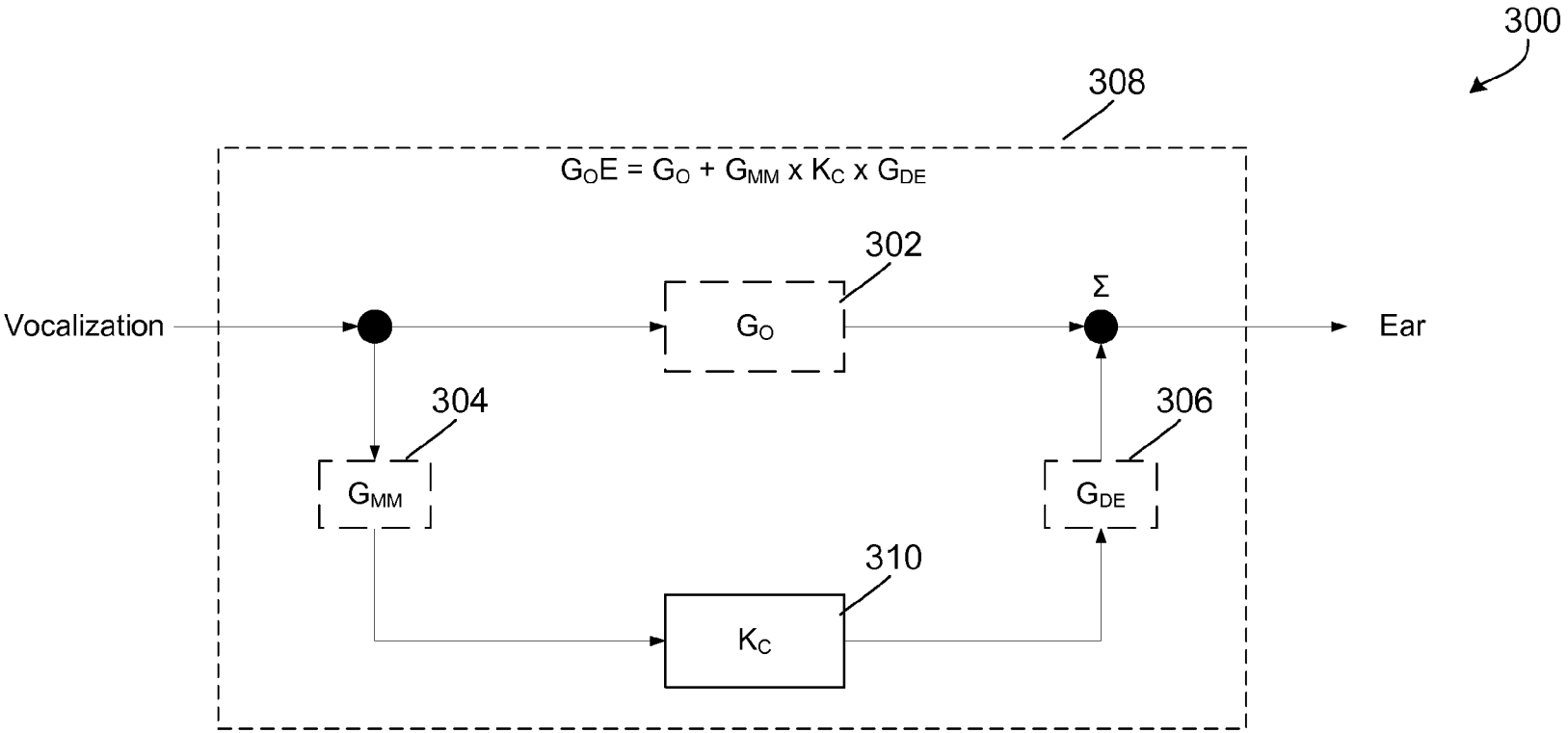
FIG. 3 shows a block diagram of an implementation of a feed-forward system that is provided in the headset to mitigate the self-voice occlusion effect.

FIG. 3 shows a block diagram of one implementation of a feed-forward system 300 that is provided in the headset 200 to mitigate the self-voice occlusion effect that the headset wearer would experience when he speaks, for example, during a phone call, while providing voice commands such as voice dial, or when recording a voice memo. Referring also to FIG. 1C, the feed-forward system 300 includes a self-voice occlusion effect compensator, $K_C$ 310. The physical transfer functions, which are depicted in dash-lined blocks 302, 304, and 306, are defined as follows:

a) $G_O$ 302: Ratio of sound pressure at the occluded and unaided ear to voice-generated sound pressure at a Mouth Reference Point ("MRP").

b) $G_{MM}$ 304: Ratio of voltage output of the communications voice microphone 120 to voice-generated sound pressure at the MRP.

c) $G_{DE}$ 306: Ratio of sound pressure at the occluded and unaided ear to the voltage input to a driver of the headset.

Generally, the feed-forward system 300 processes audio signals carrying speech uttered by the headset wearer and detected by the communications voice microphone 220, using the self-voice occlusion effect compensator, $K_C$ 310, to actively attenuate low frequency self-voice sound pressure and amplify high frequency self-voice sound pressure within the ear canals. The signals carrying the processed near-end speech that are outputted to transducers 216, 218 in the headset 200 allow the headset wearer to hear his own voice naturally through the headset 200 with minimal delay. In the implementation of the feed-forward system 300 depicted in FIG. 3, the self-voice occlusion effect compensator, $K_C$ 310, can be designed and tuned such that $G_O$E 308, the sum of self-voice audio received via the occluded and unaided path, $G_O$, and the self-voice audio received via the occluded and electronically-aided path, $G_{MM}*K_C*G_{DE}$, is as close as possible to $G_U$, a ratio of the sound pressure within the ear canal to the sound pressure at the mouth reference point when the ear is unoccluded (as illustratively depicted in FIG. 1A). This relationship can be represented by the following equation:

$$G_U=G_OE^{def}=G_O+G_{MM}\times K_C\times G_{DE}$$

Solving the above equation for $K_C$ leads to:

$$K_C=\frac{G_U-G_O}{G_{MM}\times G_{DE}},$$

In effect, the self-voice occlusion effect compensator, $K_C$ 310, actively attenuates the sound pressure at frequencies where occlusion causes amplification and amplifies the sound pressure at frequencies where occlusion causes attenuation at the headset wearer's ears when they are occluded by the headset 200.

To illustrate the performance of the techniques, described above, for mitigating self-voice occlusion in a headset, experiments were performed on a test subject. The resulting measurements and computations are shown in the graphs depicted in FIGS. 4 and 5.

Figure 4:
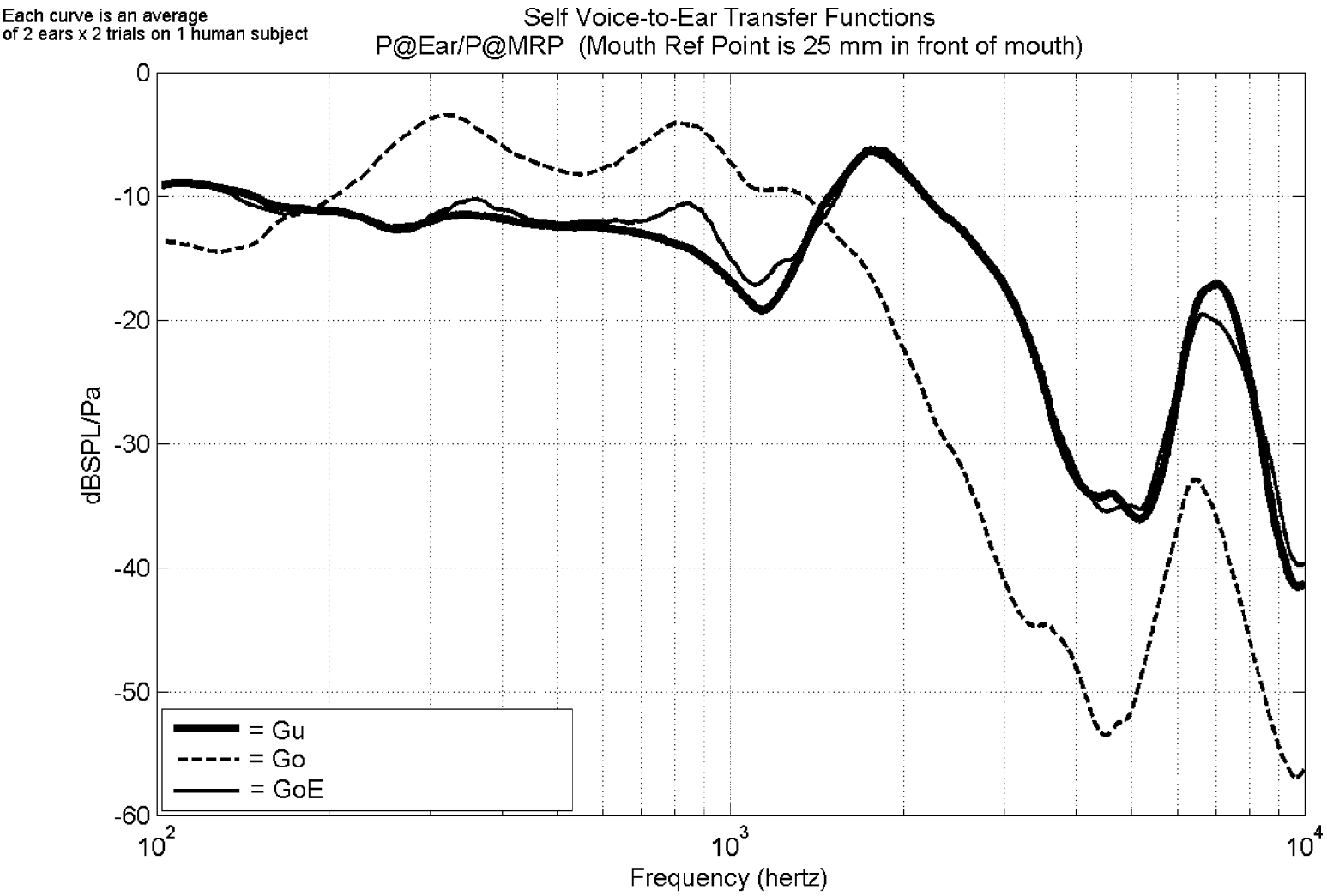
FIG. 4 shows three curves, each representing a ratio of the sound pressure at the ear of a particular test subject to the voice-generated sound pressure at a mouth reference point.

FIG. 4 shows three curves, each representing a ratio of the sound pressure at the ear of a particular test subject to the sound pressure at the MRP. As used herein with reference to FIGS. 4 and 5, the term "at the ear" refers to placement of a microphone inside the test subject's ear canal and the MRP is 25 mm in front of the mouth opening of the test subject. Each curve is an average of four measurements, and includes two ears and two trials (measurements). To perform a trial, the test subject reads for 60 seconds while the microphone signals (at the two ears and at the MRP) are recorded.

The thick solid line of FIG. 4 represents the measured unoccluded response, $G_U$ (Pressure at unoccluded ear/Pressure at MRP); the dashed line of FIG. 4 represents the measured response, $G_O$ 302 (Pressure at occluded and unaided ear/Pressure at MRP); the thin solid line of FIG. 4 represents the computed response, $G_OE$ 308 (Pressure at occluded and electronically-aided ear/Pressure at MRP). As can be seen, much of the thin solid line representing the computed response, $G_OE$ 308, is hidden behind the thick solid line representing the measured unoccluded response, G. This signifies that the self-voice occlusion effect compensator, $K_C$ 310, is appropriately designed and tuned for the particular test subject such that the self-voice occlusion effect is reduced or eliminated by the ordinary operation of the feed-forward system 300.

Figure 5:
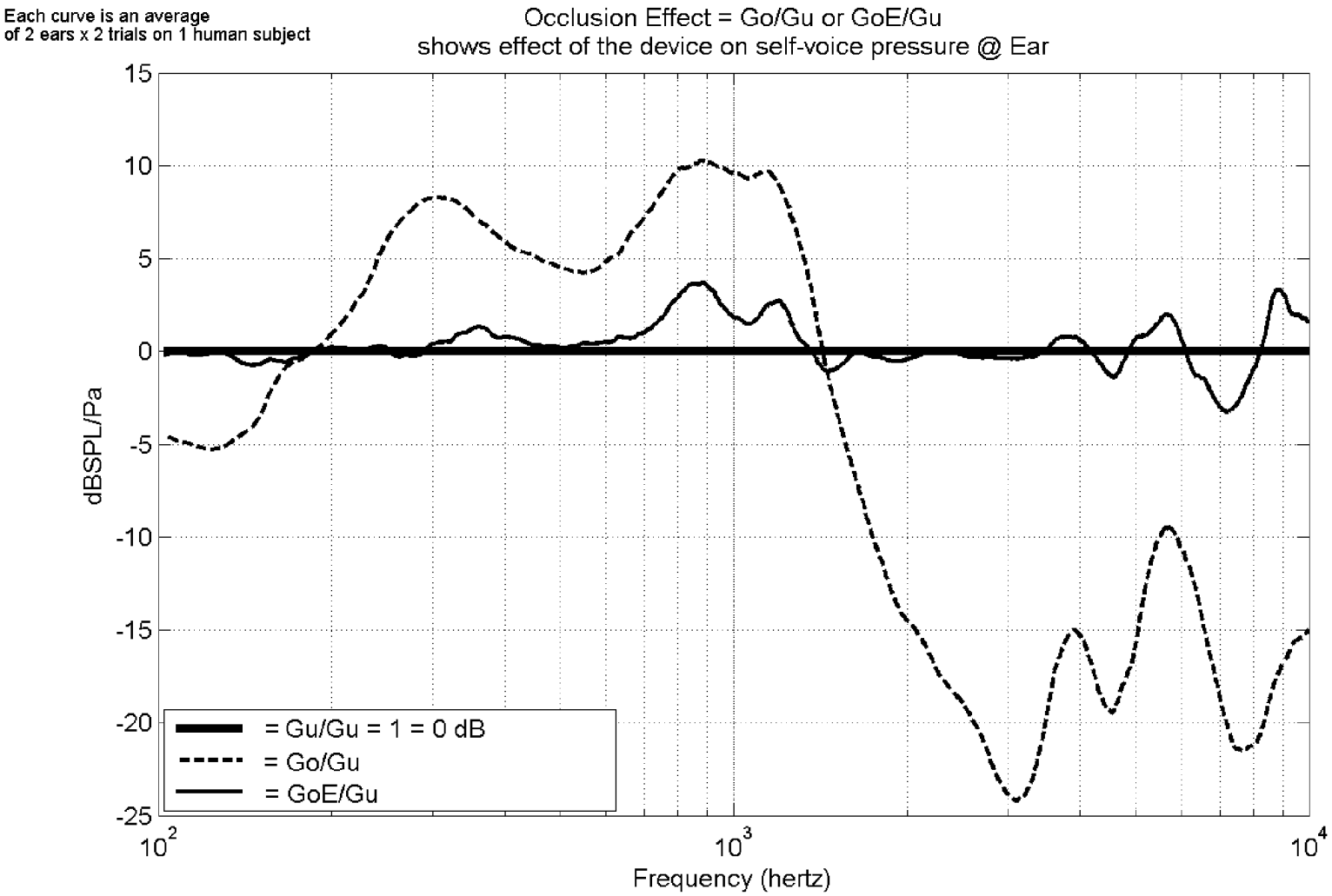
FIG. 5 shows three curves, each representing an occlusion effect experienced by a particular test subject under a different condition.

FIG. 5 shows three curves, each representing an occlusion effect experienced by the particular test subject under a different condition. Each curve of FIG. 5 depicts a different way to view the data that is visually represented in FIG. 4. The thick solid line of FIG. 5 represents the ideal target occlusion effect of $G_U/G_U=1$ at 0 dB across the graph; the dashed line of FIG. 5 represents the measured occlusion effect of $G_O/G_U$, where the measured values of $G_O$ from FIG. 4 are plotted against the measured values of $G_U$ from FIG. 4; the thin solid line of FIG. 5 represents the computed occlusion effect of $G_OE/G_U$, where the computed values of $G_OE$ from FIG. 4 are plotted against the measured values of $G_U$ from FIG. 4. The positive gain in the dashed line of FIG. 5 represents the bass boost that the test subject experiences through the unaided path of the headset. The thin solid line of FIG. 5, which represents the computed occlusion effect of $G_OE/G_U$, shows the effect of the self-voice occlusion effect compensator, $K_C$ 310, in mitigating self-voice occlusion.

Although the techniques, described above, for mitigating self-voice occlusion in a headset are illustrated in FIGS. 4 and 5 with reference to experiments that were performed on a particular test subject, a self-voice occlusion effect compensator can also be designed and tuned such that $G_OE$ is as close as possible to a target mouth-to-ear response that is representative of an average test subject in order to provide good self-naturalness for a large population of users.

In some implementations of a feed-forward system that is provided in a headset to mitigate the self-voice occlusion effect that the headset wearer would experience when he speaks, the self-voice occlusion effect compensator, $K_C$, is designed and tuned such that $G_OE$, the sum of self-voice audio received via the unaided path, $G_O$, and the self-voice audio received via the active electro-acoustic path, $G_{MM}*K_C*G_{DE}$, is as close as possible to $G_T$, a target mouth-to-ear response. In one example, the headset is implemented with a user-controlled mode switch that, when activated by the headset wearer, dynamically tunes the compensator such that $G_T$ is set at $0.5*G_U$. In so doing, the self-voice audio that is presented to the headset wearer is softer than the natural level, which would encourage the headset wearer to speak at a louder level so that he can be heard more easily by the far-end party to the phone call. In another example, the headset is implemented with software that automatically triggers a privacy mode when the headset wearer is on a phone call. In such an example, the compensator is dynamically tuned such that $G_T$ is set at $2*G_U$, which causes the self-voice audio that is presented to the headset wearer to be louder than the natural level. This would encourage the headset wearer to speak more softly, thus increasing the privacy of the conversation.

In some implementations of a feed-forward system that is provided in a headset to mitigate the self-voice occlusion effect that the headset wearer would experience when he speaks, the self-voice occlusion effect compensator is designed and tuned such that $G_OE$, the sum of self-voice audio received via the unaided path, $G_O$, and the self-voice audio received via the active electro-acoustic path, $G_{MM}*K_C*G_{DE}$, is as close as possible to $G_U$ in one or more frequency bands, including, for example, a voice frequency band that ranges from approximately 100 Hz to 7 kHz. In particular, the compensator may be designed and tuned such that $G_OE$ is as close as possible to $G_U$ in the portion of the voice frequency band in which there is amplification due to the occlusion effect. In some cases, the tuning is performed to optimize self-voice occlusion mitigation for a particular headset. In other cases, the tuning is performed in a manner that optimizes self-voice occlusion mitigation for a particular headset and headset wearer combination.

In some implementations of a feed-forward system that is provided in a headset to mitigate the self-voice occlusion effect that the headset wearer would experience when he speaks, the self-voice occlusion effect compensator is designed and tuned to roll off the lower frequencies so as to reduce unwanted background noise, reduce susceptibility to wind noise, and/or reduce overload caused by aberrant incidents (e.g., a car door slamming shut while the headset wearer is inside the car). The compensator can also be designed and tuned to roll off the higher frequencies so as to reduce unwanted background noise. In some implementations, the tuning is performed dynamically based on a detected amount of background noise. In such implementations, when the detected amount of background noise exceeds a particular threshold, the compensator mitigates the self-voice occlusion effect within a voice frequency band that is smaller relative to that when the detected amount of background noise is below the particular threshold. Further, when the detected amount of background noise is negligible, the compensator mitigates the self-voice occlusion effects with full spectral fidelity over a significant portion of the voice frequency band.

A number of implementations have been described. Nevertheless, it will be understood that additional modifications may be made without departing from the scope of the inventive concepts described herein, and, accordingly, other embodiments are within the scope of the following claims.

What is claimed is:

1. A device comprising:

an ear occluder;

an output transducer that is acoustically coupled to an ear canal of a wearer of the device;

a voice microphone configured to generate a first electrical signal that is proportional to a voice-generated sound pressure at the microphone;

signal processing circuitry, electrically coupled to the output transducer and the microphone, wherein the circuitry includes:

a compensator configured to generate, from the first electrical signal, a second electrical signal, and output the second electrical signal to the output transducer, wherein the compensator is tuned to cause $G_O E$, a ratio of a sound pressure within the ear canal to a voice-generated sound pressure at a mouth reference point when the ear is occluded and electronically-aided to be approximately equal to $G_u$, a ratio of the sound pressure within the ear canal to the voice-generated sound pressure at the mouth reference point when the ear is unoccluded, wherein the compensator is a linear-time-invariant filter with a frequency response that is defined by $$K_C = \frac{G_U - G_O}{G_{MM} \times G_{DE}};$$

$G_O$ is a ratio of a sound pressure within the ear canal to the voice-generated sound pressure at the mouth reference point when the ear is occluded and unaided;

$G_{MM}$ is a ratio of voltage output from the voice microphone to the voice-generated sound pressure at the mouth reference point; and $G_{DE}$ is a ratio of the sound pressure within the ear canal to the voltage input to a driver of the communications device.

2. The device of claim 1, wherein the compensator is tuned to cause $G_O E$ to be approximately equal to $G_U$ over one or more predetermined bands of frequencies.

3. The device of 1, wherein the compensator is tuned to cause $G_O E$ to be approximately equal to $G_U$ over a band of frequencies that experiences occlusion effect amplification.

4. The device of claim 1, wherein the compensator is tuned to perform one or more of the following: roll off frequencies above a first threshold and roll off frequencies below a different, second threshold.

5. The device of claim 1, wherein the compensator is tuned to actively attenuate low frequency self-voice sound pressure and amplify high frequency self-voice sound pressure within the ear canal.

6. The device of claim 1, further comprising:

a second ear occluder; and a second output transducer that is electrically coupled to the signal processing circuitry and acoustically coupled to a second ear canal of the wearer of the device;

wherein the compensator is further configured to output the second electrical signal to the second output transducer, and wherein the compensator is tuned to cause $G_O E$, the ratio of the respective sound pressure within each of the first and the second ear canals to the voice-generated sound pressure at a mouth reference point to be approximately equal to $G_U$.

7. The device of claim 1, wherein the ear occluder is a circumaural or supra-aural ear cup, an ear bud, or an in-the-canal component.

8. In a device including an ear occluder, an output transducer that is acoustically coupled to an ear canal of a wearer of the device, a voice microphone configured to generate a first electrical signal that is proportional to a voice-generated sound pressure at the microphone, and signal processing circuitry, electrically coupled to the output transducer and the voice microphone, a method for mitigating self-voice occlusion comprising:

generating, by a compensator of the circuitry, from the first electrical signal, a second electrical signal, and outputting the second electrical signal to the output transducer, wherein the compensator is tuned to cause $G_O E$, a ratio of a sound pressure within the ear canal to a voice-generated sound pressure at a mouth reference point when the ear is occluded and electronically-aided to be approximately equal to $G_U$, a ratio of the sound pressure within the ear canal to the voice-generated sound pressure at the mouth reference point when the ear is unoccluded; by tuning the compensator to have a frequency response that is defined by $$K_C = \frac{G_U - G_O}{G_{MM} \times G_{DE}},$$

wherein $G_O$ is a ratio of a sound pressure within the ear canal to the voice-generated sound pressure at the mouth reference point when the ear is occluded and unaided;

$G_{MM}$ is a ratio of voltage output from the voice microphone to the voice-generated sound pressure at the mouth reference point; and $G_{DE}$ is a ratio of the sound pressure within the ear canal to the voltage input to a driver of the communications device.

9. The method of claim 8, further comprising:

tuning the compensator to cause $G_O E$ to be approximately equal to $G_U$ over one or more predetermined bands of frequencies.

10. The method of claim 8, further comprising:

tuning the compensator to cause $G_O E$ to be approximately equal to $G_U$ over a band of frequencies that experiences occlusion effect amplification.

11. The method of claim 8, further comprising:

tuning the compensator to perform one or more of the following: roll off frequencies above a first threshold and roll off frequencies below a different, second threshold.

12. The method of claim 8, further comprising:

converting, by the transducer, the second electrical signal to acoustic energy that actively attenuates low frequency self-voice sound pressure in the ear canal and amplifies high frequency self-voice sound pressure in the ear canal.

13. A device comprising:

a first ear occluder and a second ear occluder;

a first output transducer that is acoustically coupled to a first ear canal of a first ear of a wearer of the device;

a second output transducer that is acoustically coupled to a second ear canal of a second ear of the wearer of the device;

a voice microphone configured to generate a first electrical signal that is proportional to a voice-generated sound pressure at the microphone; and signal processing circuitry, electrically coupled to the first and the second output transducers and the voice microphone, wherein the circuitry includes:

a compensator configured to generate, from the first electrical signal, a second electrical signal, and output the second electrical signal to the first and the second output transducers, wherein the compensator is tuned to cause $G_O E$, an average ratio of a sound pressure within the first and the second ear canals to the voice-generated sound pressure at a mouth reference point to be approximately equal to $G_U$, a ratio of a sound pressure within the ear canal to the voice-generated sound pressure at the mouth reference point when the ear is unoccluded, wherein the compensator is a linear-time-invariant filter with a frequency response that is defined by $$K_C = \frac{G_T - G_O}{G_{MM} \times G_{DE}};$$

$G_O$ is a ratio of a sound pressure within the ear canal to the voice-generated sound pressure at the mouth reference point when the ear is occluded and unaided;

$G_{MM}$ is a ratio of voltage output from the voice microphone to the voice-generated sound pressure at the mouth reference point; and $G_{DE}$ is a ratio of the sound pressure within the ear canal to the voltage input to a driver of the communications device.

14. A device comprising:

an ear occluder;

an output transducer that is acoustically coupled to an ear canal of a wearer of the device;

a voice microphone configured to generate a first electrical signal that is proportional to a voice-generated sound pressure at the microphone;

signal processing circuitry, electrically coupled to the output transducer and the voice microphone, wherein the circuitry includes:

a compensator configured to generate, from the first electrical signal, a second electrical signal, and output the second electrical signal to the output transducer, wherein the compensator is tuned to cause $G_O E$, a ratio of a sound pressure within the ear canal to the voice-generated sound pressure at a mouth reference point when the ear is occluded and electronically-aided to be approximately equal to $G_T$, a target ratio of sound pressure within the ear to the voice-generated sound pressure at the mouth reference point when the ear is occluded and electronically-aided that is selected to provide a predetermined self-voice experience, wherein the compensator is a linear-time-invariant filter with a frequency response that is defined by $$K_C = \frac{G_T - G_O}{G_{MM} \times G_{DE}};$$

$G_O$ is a ratio of a sound pressure within the ear canal to the voice-generated sound pressure at the mouth reference point when the ear is occluded and unaided;

$G_{MM}$ is a ratio of voltage output from the voice microphone to the voice-generated sound pressure at the mouth reference point; and $G_{DE}$ is a ratio of the sound pressure within the ear canal to the voltage input to a driver of the communications device.

15. The device of claim 14, wherein:

$G_T = 2 * G_U$;

$G_U$ is a ratio of a sound pressure within the ear canal to the voice-generated sound pressure at the mouth reference point when the ear is unoccluded; and the predetermined self-voice experience is louder than a natural self-voice experience.

16. The device of claim 14, wherein:

$G_T = 0.5 * G_U$;

$G_U$ is a ratio of a sound pressure within the ear canal to the voice-generated sound pressure at the mouth reference point when the ear is unoccluded; and the predetermined self-voice experience is softer than a natural self-voice experience.

17. The device of claim 14, wherein the compensator is dynamically tuned in response to a user-controlled mode selection.

18. The device of claim 14, wherein the compensator is dynamically tuned in response to detection that the headset is engaged in an active telephone call with a far-end communications device.

* * * * *